US008179222B2

(12) United States Patent
Lee et al.

(10) Patent No.: US 8,179,222 B2
(45) Date of Patent: May 15, 2012

(54) TRANSFORMER WITH CONDUCTIVE PLATE WINDING STRUCTURE

(75) Inventors: Chung-Shu Lee, Taipei Hsien (TW); Shih-Chang Lee, Taipei Hsien (TW); Chi-Hsien Weng, Taipei Hsien (TW); Fu-Teng Hou, Taipei Hsien (TW)

(73) Assignee: Chicony Power Technology Co., Ltd., Taipei Hsien (TW)

( * ) Notice: Subject to any disclaimer, the term of this patent is extended or adjusted under 35 U.S.C. 154(b) by 308 days.

(21) Appl. No.: 12/615,341

(22) Filed: Nov. 10, 2009

(65) Prior Publication Data

US 2011/0109418 A1 May 12, 2011

(51) Int. Cl.
*H01F 27/30* (2006.01)

(52) U.S. Cl. ..... 336/208

(58) Field of Classification Search ..... 336/65, 336/83, 90, 92, 192, 198, 200, 220–223, 336/208

See application file for complete search history.

(56) References Cited

U.S. PATENT DOCUMENTS

| | | | | |
|---|---|---|---|---|
| 3,609,859 | A * | 10/1971 | Hunt et al. | 29/605 |
| 7,439,838 | B2 * | 10/2008 | Chen et al. | 336/198 |
| 7,439,839 | B2 * | 10/2008 | Podlisk et al. | 336/200 |
| 7,498,921 | B1 * | 3/2009 | Wang | 336/200 |
| 2008/0100407 | A1 * | 5/2008 | Yamaguchi et al. | 336/192 |

* cited by examiner

*Primary Examiner* — Tuyen Nguyen

(74) *Attorney, Agent, or Firm* — Chun-Ming Shih; HDLS IPR Services

(57) ABSTRACT

A transformer with a conductive plate winding structure includes a hollow core pillar, a partition, a conductive plate winding structure, and an insulating layer. The partition is fixed at the hollow core pillar for partitioning the hollow core pillar into two winding areas. The conductive plate winding structure is sheathed to the hollow core pillar and disposed at one of the two winding areas, and comprised of a plurality of conductive plates, and each conductive plate includes a ring having an opening and two conductive terminals extended out from the opening of the ring. The insulating layer is clamped between any two adjacent conductive plates, such that the conductive plates are stacked to from a winding for increasing the rated normal current and enhancing the assembling convenience.

14 Claims, 6 Drawing Sheets

TRANSFORMER WITH CONDUCTIVE PLATE WINDING STRUCTURE

BACKGROUND OF THE INVENTION

1. Field of the Invention

The present invention relates to a transformer, and more particularly to a transformer with a conductive plate winding structure for increasing rated normal current and enhancing thermal conductivity.

2. Description of Prior Art

As electric power is generated in electric power plants, and the loss of electric power can be reduced by a high voltage and a low current during a power transmission through electric cables, the high voltage can be stepped down by transformer and transmitted to end users to fit the specifications of products at a loading end. For personal electric appliances such as computer equipments used in daily life also require the transformer to convert alternate current (AC) power into an appropriate voltage value.

In general, a transformer includes a coil bobbin having a partition for partitioning the exterior of the coil bobbin into two sides, and both sides are wound with winding modules having different numbers of coils to form a primary winding module and a secondary winding module respectively, wherein the interior of the coil bobbin includes a through hole for installing an iron core, and the primary winding module is coupled to a power supply terminal, and a change of magnetic flux will be produced in the iron core if a current is passed through the primary winding module, and the secondary winding module is coupled to a loading end for generating a current due to an induced electromotive force. In ideal conditions, the magnetic flux of each winding turn is the same, and thus the induced voltage is directly proportional to the number of winding turns, and the induced current is inversely proportional to the number of winding turns. If the number of winding turns of the secondary winding module is less than that of the primary winding module, then the loading end will generate an induced voltage of a high-voltage current at the power supply terminal.

However, a single conductive wire of the winding module comes with a limited wire diameter and permits a small current only, and thus the current passed through the conductive wire winding module will generate heat due to the electric resistance, and it is more difficult to dissipate the heat generated within the conductive wire winding modules than the heat generated at an external area wound by the conductive wire winding modules due to the coating of insulating paints. If the outermost surface of the conductive wire winding module is attached with a heat dissipating device, then a rough surface will be formed on each wound conductive wire winding module, and thus the efficiency for the conductive wire winding module to conduct heat to the heat dissipating device will be low. Furthermore, an end of the coil bobbin is coupled to a terminal block for electrically coupling the conductive wire winding module, and the terminal block is plugged to an external circuit board, so that the structure of the terminal block usually comes with a complicated design, and the winding module is wound in a more inconvenient way.

In view of the shortcomings of the prior art, the inventor of the present invention based on years of experience in the related field to conduct extensive researches and experiments, and finally developed a transformer with a conductive plate winding structure in accordance with the present invention and provided a feasible effective solution to overcome the shortcomings of the prior art.

SUMMARY OF THE INVENTION

Therefore, it is a primary objective of the present invention to provide a transformer with a conductive plate winding structure, wherein conductive plates are stacked to form a winding module for increasing rated normal current and improving assembling convenience.

To achieve the foregoing objective, the present invention provides a transformer with a conductive plate winding structure, comprising:

- a hollow core pillar;
- a partition, fixed to the hollow core pillar, for partitioning the hollow core pillar into two winding areas;
- a conductive plate winding structure, sheathed onto the hollow core pillar and disposed in one of the two winding areas, and comprised of a plurality of conductive plates, and each conductive plate including a ring having an opening and two conductive terminals extended out from the opening of the ring; and
- an insulating layer, clamped between any two adjacent conductive plates.

The present invention is characterized in that the winding accomplished by a plurality of conductive plates makes the assembling process more convenient, and the conductive plates can be plugged directly into insert holes on the circuit board to waive the installation of terminals, and the total sum of cross-sectional areas of a current path of the conductive plates is greater than the total sum of cross-sectional areas of a current path of the winding modules occupied in the same space, and thus a greater rated normal current can be passed, and the invention can be applied for applications requiring a larger current. The coils accomplished by winding a plurality of conductive plates provide a quick and uniform heat conduction from the interior to the exterior of a same conductive plate, and the top of the conductive plate has a flat surface, such that when the top of the conductive plate is attached with the heat dissipating device, the efficiency of conducting heat from the conductive plate to heat dissipating device is high.

DETAILED DESCRIPTION OF THE INVENTION

Figure 1:
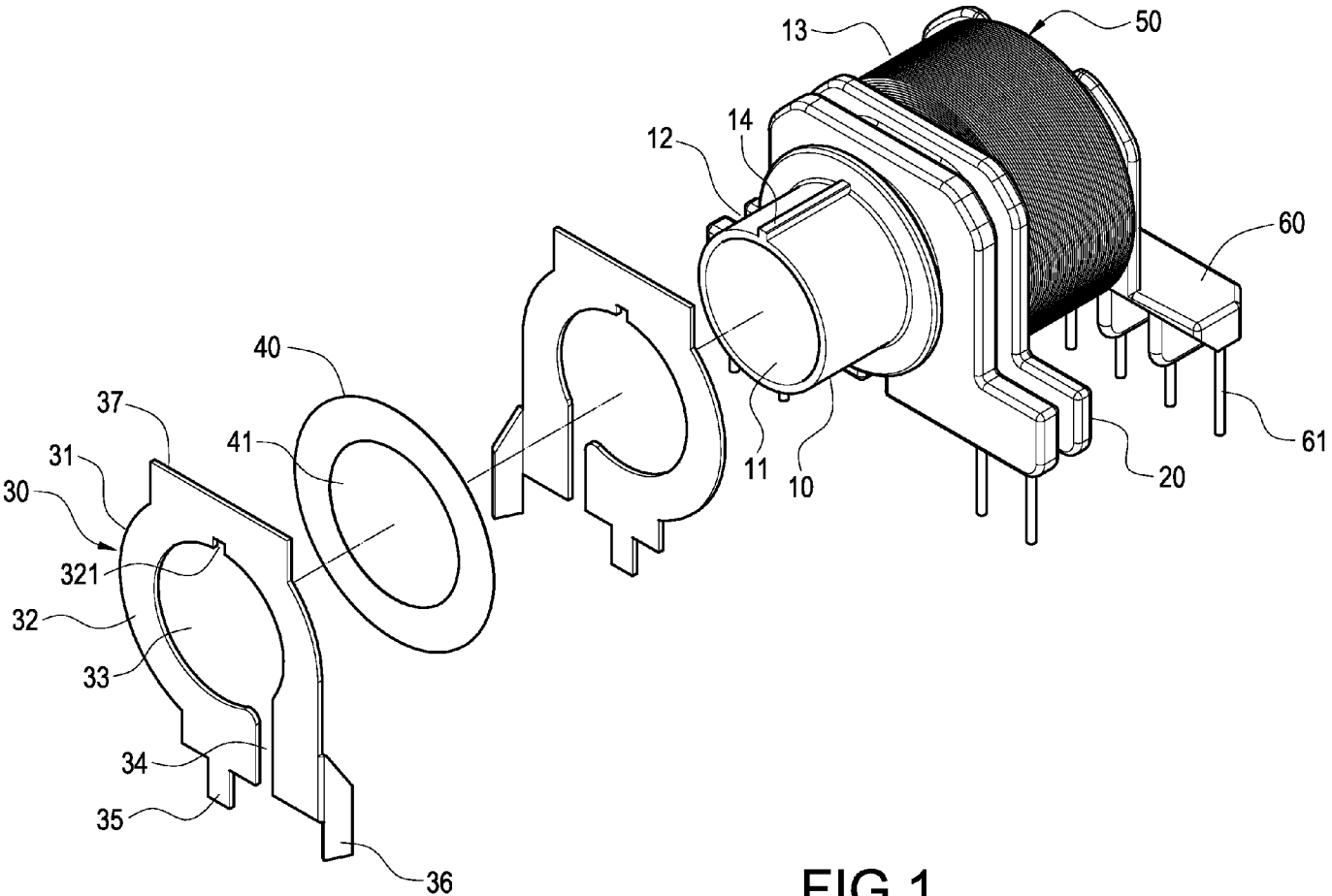
FIG. 1 is an exploded view of a winding structure of the present invention.

The technical characteristics, features and advantages of the present invention will become apparent in the following detailed description of the preferred embodiments with reference to the accompanying drawings. The drawings are provided for reference and illustration only, but not intended for limiting the present invention.

The present invention discloses a transformer with a conductive plate winding structure, comprising a hollow core pillar 10, a partition 20, a conductive plate winding structure 30, an insulating layer 40, a winding module 50, a terminal block 60, a casing 70, and a circuit board 80.

With reference to FIG. 1 for an exploded view of a winding structure of the present invention, the hollow core pillar 10 is in a cylindrical shape, but not limited to such shape only, and the hollow core pillar 10 includes a core hole 11 for passing an iron core (not shown in the figure), and the hollow core pillar 10 is made of an insulating material including but not limited to plastic only; the partition 20 is fixed to the periphery at a central position of the hollow core pillar 10 for partitioning the hollow core pillar 10 into two winding areas, respectively, i.e. a primary side winding area 12 and a secondary side winding area 13, and the partition 20 is made of an insulating material including but not limited to plastic only, and the hollow core pillar 10 has a protruding ridge 14 protruded along an axial direction of the secondary side winding area 13.

The conductive plate winding structure 30 is sheathed onto the hollow core pillar 10, disposed in the secondary side winding area 13, and comprised of a plurality of conductive plates, wherein the conductive plate 31 is made of a conductive material including but not limited to copper and aluminum only, and the structure of the conductive plate 31 includes a ring 32 having an opening 34 and two conductive terminals extended out from the opening 34 of the ring 32, wherein the opening 34 is formed at the bottom of the ring 32, and a notch 321 is formed at the internal periphery of the ring 32 for embedding the protruding ridge 14, and a penetrating hole 33 is formed at the center of the ring 32, interconnected with the notch 321, and provided for passing the hollow core pillar 10, and the two electro-conductive ends are a first conductive terminal 35 and a second conductive terminals 36 respectively, and the first conductive terminal 35 and the second conductive terminals 36 are electrically plugged into insert holes (not shown in the figure) on the circuit board 80, and a thermal conductive plane 37 is formed and protruded from the top of the conductive plate 31, and the top of the thermal conductive plane 37 is a flat structure.

The insulating layer 40 is sheathed securely to the hollow core pillar 10, disposed in the secondary side winding area 13, and clamped between any two adjacent conductive plates 31, wherein the insulating layer 40 is made of an insulating material including but not limited to plastic only, and the structure of the insulating layer 40 is substantially a circular plate having a through hole 41 at the center of the circular plate for passing the hollow core pillar 10, and the area of the circular plate of the insulating layer 40 is substantially equal to and superimposed onto the circular area of the conductive plate 31.

The winding module 50 is wound around the hollow core pillar 10, disposed in the primary side winding area 12, and made of a copper wire, whose surface is coated with a layer of insulating paint, but not limited to such material or structure only. The winding module 50 is separated from the conductive plate winding structure 30 by the partition 20.

The terminal block 60 is coupled to an end of the hollow core pillar 10 and disposed in the primary side winding area 12, and a plurality of insert pins 61 are protruded from the bottom of the terminal block 60 for electrically coupling both ends of the winding module 50 and being electrically plugged into insert holes (not shown in the figure) of the circuit board 80.

Figure 2:
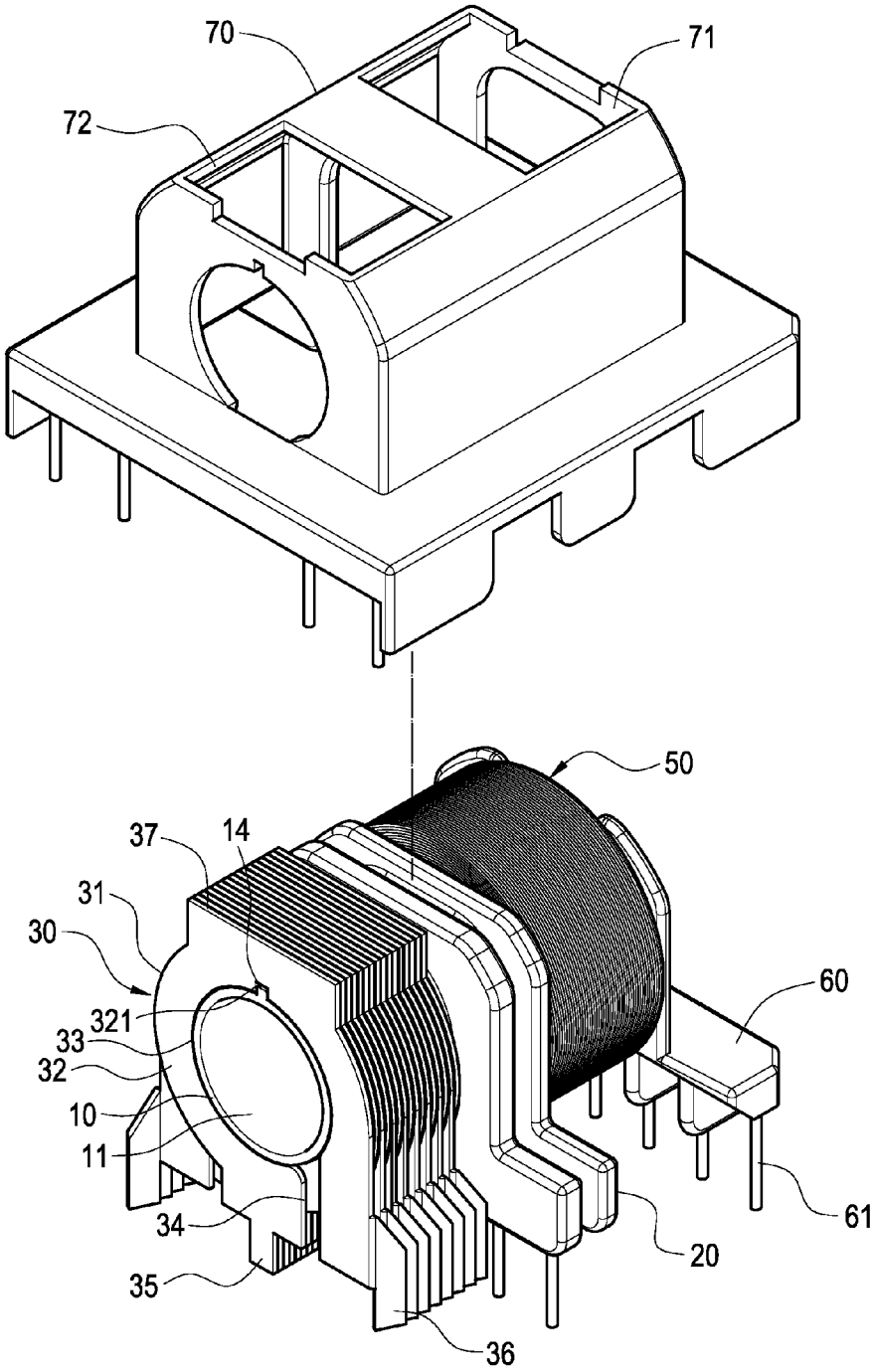
FIG. 2 is an exploded view of protecting components covered onto the exterior of the present invention.
Figure 3:
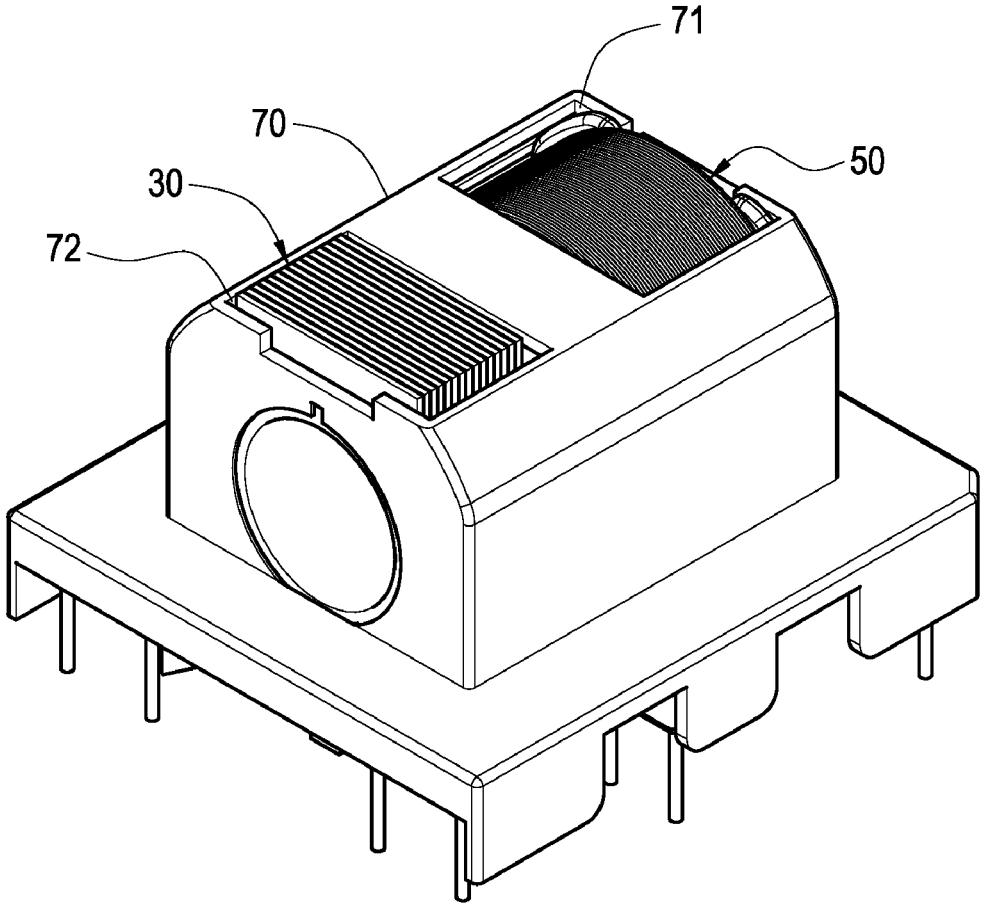
FIG. 3 is a perspective view of protecting components covered onto the exterior of the present invention.

With reference to FIGS. 2 and 3 for an exploded view and a perspective view of protecting components covered onto the exterior of the present invention respectively, the casing 70 can be an external protective device provided for covering the hollow core pillar 10, the partition 20, the conductive plate winding structure 30, the insulating layer 40, the winding module 50, and the terminal block 60 to prevent external foreign matters from entering into the casing. The casing 70 is made of an insulating material including but not limited to plastic only. In the structure of the casing 70, two openings are formed at the top of the casing 70 and disposed in the two winding areas respectively, and the two openings are a primary side opening 71 and a secondary side opening 72, wherein the primary side opening 71 is formed corresponding to the primary side winding area 12 for exposing the top of the winding module 50 wound on the hollow core pillar 10, such that the top of the winding module 50 can be attached to a heat dissipating device, and the secondary side opening 72 is formed corresponding to the secondary side winding area 13 for exposing the thermal conductive plane 37, such that the top of the thermal conductive plane 37 can be attached to the heat dissipating device.

Figure 4:
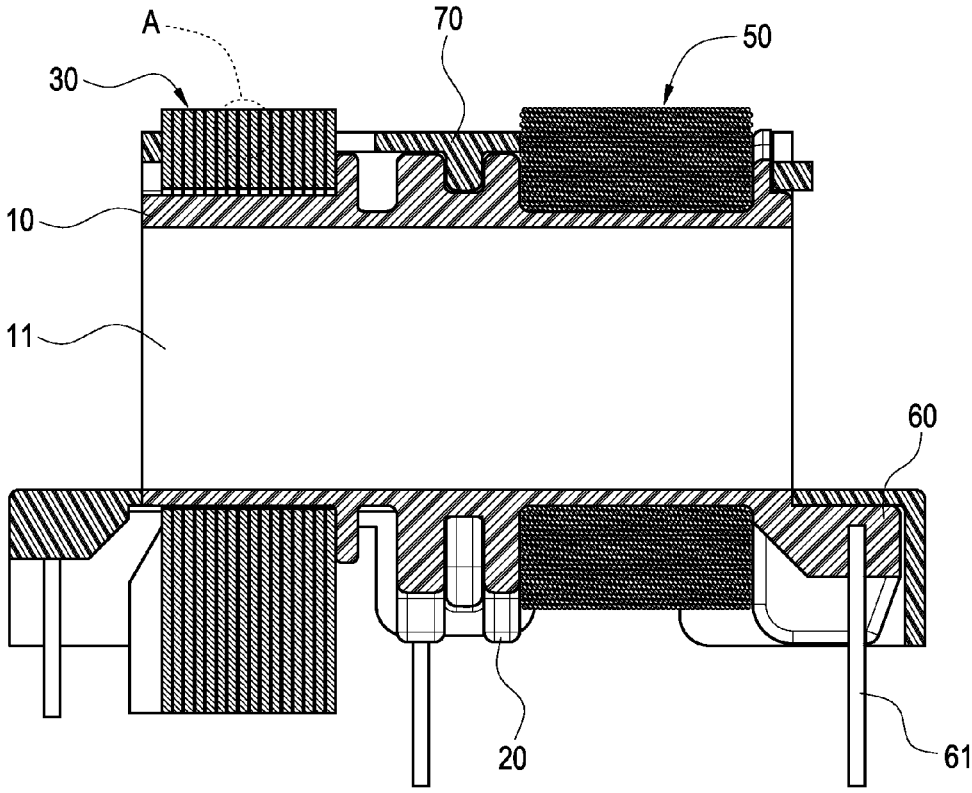
FIG. 4 is a cross-sectional side view of FIG. 3.
Figure 5:
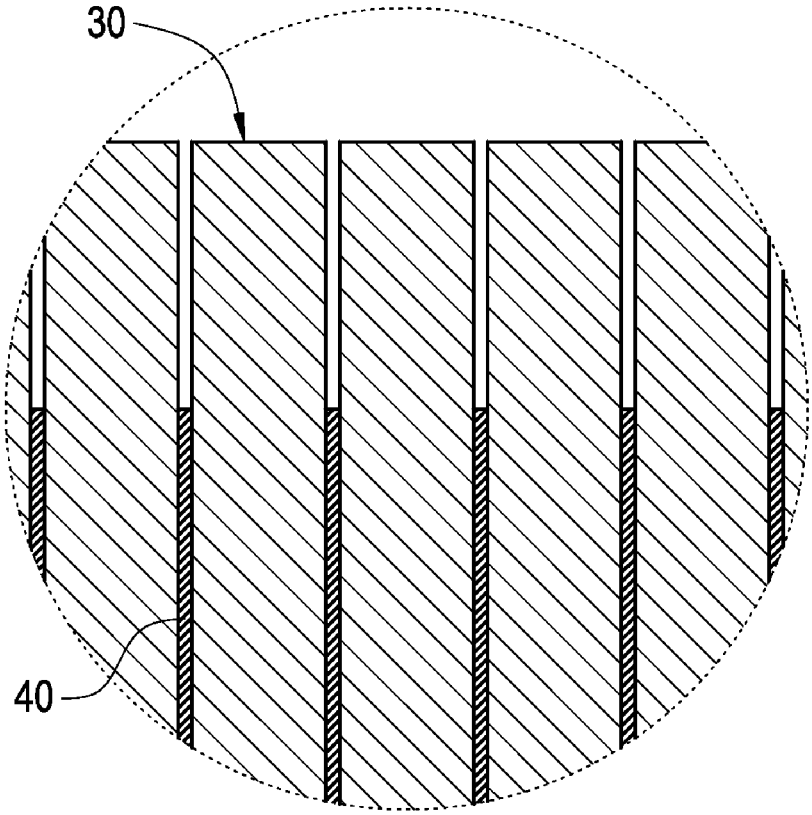
FIG. 5 is a partial enlarged view of area A of FIG. 4.
Figure 6:
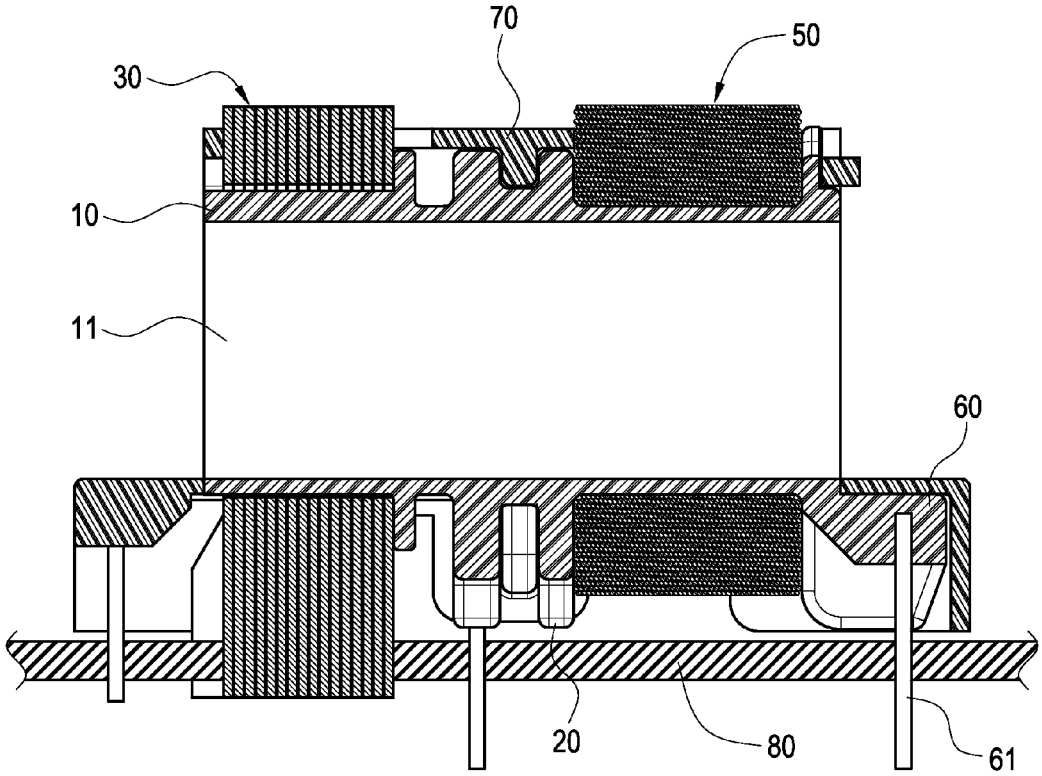
FIG. 6 is a cross-sectional view of a conductive plate electrically installed into a circuit board in accordance with the present invention.

With reference to FIGS. 4 to 6 for a cross-sectional side view, a partial enlarged view of section A of FIG. 4, and a cross-sectional view of a conductive plate electrically plugged to a circuit board in accordance with the present invention respectively, the first conductive terminal 35, the second conductive terminals 36, and the insert pins 61 are electrically plugged into the insert holes of the circuit board 80 respectively for electrically coupling the circuit board 80 with an external voltage source. Now, both ends of the winding module 50 are electrically coupled to the insert pins 61, and a current is passed through the winding module 50 wound in the primary side winding area 12 for driving an iron core (not shown in the figure) passed into the hollow core pillar 10 to generate a magnetic flux, such that the conductive plates 31 of the secondary side winding area 13 generate an induced current, and the induced current is passed into a circuit of the circuit board 80 through the first conductive terminals 35 and the second conductive terminals 36 plugged into the insert holes of the circuit board 80, wherein the first conductive terminals 35 and the second conductive terminals 36 are plugged directly into the insert holes of the circuit board 80 to waive the installation of terminals.

The sum of cross-sectional areas of a current path of the conductive plates 31 is greater than the sum of cross-sectional areas of a current path of the winding modules occupied in the same space, so that the conductive plates 31 stacked with each other can increase the rated normal current for applications that require a larger current, and the stacked conductive plates 31 provide a more convenient assembling way, and improve the heat dissipating effect to enhance the overall performance of the transformer.

After the winding module is wound, a current passing through the winding module will generate heat due to electric resistance, and the heat cannot be conducted easily due to the insulating paint coated between the winding modules, and it is more difficult to dissipate the heat at a position of the wound area inside the winding module than that outside the winding module, and the outermost surface of the wound area of the winding module is a rough surface attached with a heat dissipating device, so that the efficiency of conducting the heat from the winding module to the heat dissipating device is low. If the windings are accomplished by the conductive plates, the current passing through the windings will generate heat due to the electric resistance, and the heat in the same conductive plate can be conducted from the interior to the exterior quickly and uniformly. In addition, the thermal conductive plane 37 is attached with the heat dissipating device, and the flat surface of the thermal conductive plane 37 can be attached closely with the heat dissipating device, and thus the efficiency of conducting the heat from the conductive plate 31 to the heat dissipating device is very high.

In this preferred embodiment, the coils in the primary side winding area 12 are accomplished by winding the winding modules, and the coils in the secondary side winding area 13 are accomplished by winding the conductive plates. With a voltage source of a rated normal voltage, the coils in the primary side winding area 12 can be accomplished by winding the conductive plates to enhance the overall heat dissipating effect of the transformer effectively.

The present invention is illustrated with reference to the preferred embodiment and not intended to limit the patent scope of the present invention. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A transformer with a conductive plate winding structure, comprising:

a hollow core pillar;

a partition, fixed to the hollow core pillar, for partitioning the hollow core pillar into a first area and a second area located on two opposite sides of the partition along a longitudinal direction of the hollow core pillar; and a conductive plate winding structure, sheathed onto the hollow core pillar and disposed in the first area, and comprised of a plurality of conductive plates and merely an insulating layer clamped between any two adjacent conductive plates, and each conductive plate including a ring having an opening and two conductive terminals extended out from the opening of the ring.

2. The transformer with a conductive plate winding structure as recited in claim 1, further comprising a circuit board for electrically coupling the two conductive terminals.

3. The transformer with a conductive plate winding structure as recited in claim 1, wherein the hollow core pillar has a protruding ridge formed externally, and a notch formed at the internal periphery of the ring for embedding the protruding ridge.

4. The transformer with a conductive plate winding structure as recited in claim 1, wherein the conductive plate includes a thermal conductive plane formed on the periphery of the conductive plate.

5. The transformer with a conductive plate winding structure as recited in claim 1, wherein the insulating layer is a circular plate.

6. The transformer with a conductive plate winding structure as recited in claim 1, further comprising a terminal block coupled to an end of the hollow core pillar and disposed in the second area.

7. The transformer with a conductive plate winding structure as recited in claim 6, wherein the terminal block includes a plurality of insert pins formed thereon for electrically coupling the two conductive terminals.

8. The transformer with a conductive plate winding structure as recited in claim 1, further comprising a winding module wound around the hollow core pillar, and disposed in the second area.

9. The transformer with a conductive plate winding structure as recited in claim 8, further comprising a terminal block coupled to an end of the hollow core pillar and disposed in the second area.

10. The transformer with a conductive plate winding structure as recited in claim 9, wherein the terminal block includes a plurality of insert pins formed thereon for electrically coupling the two conductive terminals.

11. The transformer with a conductive plate winding structure as recited in claim 8, further comprising a casing for covering the hollow core pillar, the partition, and the conductive plate winding structure.

12. The transformer with a conductive plate winding structure as recited in claim 11, wherein the casing includes an opening for exposing a portion of the winding module.

13. The transformer with a conductive plate winding structure as recited in claim 1, further comprising a casing for covering the hollow core pillar, the partition, and the conductive plate winding structure.

14. The transformer with a conductive plate winding structure as recited in claim 13, wherein the casing includes an opening for exposing a portion of the conductive plate winding structure.

* * * * *